United States Patent [19]

Junghans

[11] 4,044,673

[45] Aug. 30, 1977

[54] DAMPENING UNIT FOR OFFSET PRINTING MACHINES

[75] Inventor: Rudi Junghans, Wilhelmsfeld, Germany

[73] Assignee: Heidelberger Druckmaschinen Aktiengesellschaft, Heidelberg, Germany

[21] Appl. No.: 708,215

[22] Filed: July 23, 1976

[30] Foreign Application Priority Data

July 25, 1975 Germany ..... 2533267

[51] Int. Cl.[2] ..... B41F 7/30

[52] U.S. Cl. ..... 101/148

[58] Field of Search ..... 101/147, 148, 363, 364–366, 101/349–352, 207–210; 118/DIG. 16, 300, 320, 321, 322; 239/219–221; 261/91, 92; 134/184, 194; 34/241

[56] References Cited

U.S. PATENT DOCUMENTS

| | | | |
|---|---|---|---|
| 2,199,093 | 4/1940 | Wolfenden | 239/220 X |
| 2,622,520 | 12/1952 | Hauser et al. | 101/147 |
| 2,954,933 | 10/1960 | Clare | 101/148 X |
| 3,008,407 | 11/1961 | Roberts et al. | 101/148 |
| 3,043,214 | 7/1962 | Christoff | 101/148 UX |
| 3,143,065 | 8/1964 | Warczak | 101/147 |
| 3,545,379 | 12/1970 | Norton | 101/148 |
| 3,759,175 | 9/1973 | Alsop | 101/148 |

FOREIGN PATENT DOCUMENTS

| | | | |
|---|---|---|---|
| 2,300,651 | 7/1974 | Germany | 101/148 |

*Primary Examiner*—J. Reed Fisher
*Attorney, Agent, or Firm*—Herbert L. Lerner

[57] ABSTRACT

Dampening unit for an offset printing machine includes at least one dampening unit roller, a container for dampening medium and a rotatable sprinkler roller disposed mutually adjacent one another, the sprinkler roller includes a shaft, a pair of discs disposed at opposite ends of the shaft and an envelope wettable by dampening medium from the containers and formed of a plurality of means displaceable in a rotary path for throwing onto the dampening-unit roller from a region of an edge of the envelope extending along the length of the sprinkler roller droplets of dampening medium withdrawn from the container, the plurality of throwing means being stressed in tension between the discs and extending parallel to the shaft, and traverse means carrying a plurality of fingers disposed adjacent to and spaced from the discs and having respective edges projecting into the rotary path of the plurality of throwing means.

15 Claims, 6 Drawing Figures

DAMPENING UNIT FOR OFFSET PRINTING MACHINES

The invention relates to a dampening unit for offset printing machines with a container for dampening medium and with a sprinkler roller associated therewith, the envelope or casing of which is formed of thrower elements which, in the region of an edge extending along the length of the roller, sprinkle dampening medium that impinges upon a dampening unit roller.

A contactless dampening unit of this general type is disclosed in German patent DT-PS 1,121,625, wherein the sprinkler roller is formed of a roller provided with brushes partly immersed in a dampening-medium container or tank. Due to the rotary movement of the roller, the bristles become wetted with dampening medium which is then sprinkled from the bristles in the region of an edge or corner thereby. In this connection, the bristles become bent and the resilient or spring action thereof is utilized to sprinkle the dampening medium. The sprinkled medium, such as water, for example, then impinges on a dampening-unit roller.

A considerable disadvantage of the heretofore known construction of such dampening units is that the bristles are subjected to pronounced bending and thereby to a high flexural or bending stress. The material of which the bristles are formed becomes fatigued by the continual bending so that it loses its elasticity. The bristles bend over and become mutually entangled. Less dampening medium is thereby picked up. Dampening medium and the additives thereof accelerate this effect by their action upon the generally organic material of the brushes, so that the brushes have to be exchanged relatively frequently. Due to the admixed additives, crystals can also form on the bristles, reducing he elasticity and absorbtivity, as well. Not infrequently, individual bristles fall out or break off and find their way into the printing machine where they can sometimes cause seriously consequential damage. Due to the variable wear of the bristles and the non-uniform elasticity thereof, differences in the transfer of dampening medium in a brush roller can occur over the width of the roller, and must be controlled or adjusted out.

It is accordingly an object of the invention to provide a dampening unit for offset printing machines that avoids the disadvantages of the heretofore known constructions of this general type which permits contactless dampening with low fog or mist-formation and operates maintenance-free for relatively long periods.

With the foregoing and other objects in view, there is provided, in accordance with the invention, a dampening unit for an offset printing machine comprising at least one dampening unit roller, a container for dampening medium and a rotatable sprinkler roller disposed mutually adjacent one another, the sprinkler roller comprising a shaft, a pair of discs disposed at opposite ends of the shaft and an envelope wettable by dampening medium from the container and formed of a plurality of means displaceable in a rotary path for throwing onto the dampening-unit roller from a region of an edge of the envelope extending along the length of the sprinkler roller droplets of dampening medium withdrawn from the container, the plurality of throwing means being stressed in tension between the discs and extending parallel to the shaft, and traverse means carrying a plurality of fingers disposed adjacent to and spaced from the discs and having respective edges projecting into the rotary path of the plurality of throwing means.

If the plurality of throwing means or thrower elements stressed in tension between the discs are held back or deflected briefly by the fingers due to the rotary movement of the sprinkler roller, then a high frequency vibration or oscillation occurs in the thrower elements stressed in tension after they spring beyond the projecting edges of the fingers. This vibration or oscillation occurs in one plane, so that the dampening medium adhering to the thrower elements is thrown off in the direction of vibration or oscillation. The relatively wide jet of dampening medium consists of individual droplets which do not form a mist or fog and thereby avoid the corrosive effect that would otherwise be exercised upon those parts of the printing machine that are formed of iron. The control of the quantity of dampening medium to be transferred is achieved in a conventional manner by varying the rotary speed of the sprinkler roller. This speed can be a function of the printing machine or need not be machine-dependent.

In accordance with another feature of the invention, the dampening unit includes compression spring means located at one end of the sprinkler roller for bracing the plurality of throwing means or thrower elements against the discs.

In accordance with a further feature of the invention, one of the discs is slideably mounted on the shaft.

In accordance with an added feature of the invention, one of the discs is resiliently and adjustably mounted on the shaft, so as to permit all of the throwing means or thrower elements to be stressed in tension simultaneously and uniformly.

In accordance with an additional feature of the invention and in order to feed a uniform quanity of dampening medium to the sprinkler roller, the dampening unit includes a roller having a water-bearing surface rotatable mounted in the dampening-medium container, the water-bearing surface being operatively engageable with the plurality of throwing means or thrower elements.

In accordance with an alternate feature of the invention, stationary absorbent elements are disposed in the dampening-medium container for transferring dampening medium therefrom to the plurality of throwing means or thrower elements. In both of these alternative advantageous embodiments, a varying water level in the dampening-medium container cannot affect the quantity of dampening medium to be transferred.

In accordance with yet another feature of the invention, the dampening unit, wherein the dampening medium droplets are thrown in a jet by a plurality of throwing means or thrower elements onto the dampening unit roller, include a protective case surrounding the sprinkler roller, the protective case being formed with a longitudinal slit and having shutter means for limiting the jet of dampening medium droplets.

In order to permit an arbitrary distribution of dampening medium across the width of the printing, there are provided, in accordance with yet a further feature of the invention, adjustable shutter means mounted on the transverse means for regulating by zones, the amount of dampening medium thrown by the plurality of throwing means onto the dampening-unit roller.

In accordance with an alternate feature of the invention, instead of adjustable shutter means, air nozzle means are provided for blowing onto the dampening-unit roller, by zones, the dampening medium on the plurality of throwing means or thrower elements.

In accordance with another feature of the invention, the plurality of throwing means or thrower elements are cables formed of material selected from the group consisting of wire and synthetics and having a water-bearing surface.

In accordance with an alternate feature of the invention, the plurality of throwing means or thrower elements constitute respective lengths of a continuous cable extending in loop-shaped conformation around the discs, and terminal members are included fastening the ends of the continuous cable in one of the discs.

In order to prevent wear and, in accordance with another feature of the invention, the plurality of throwing means, which are in cable form, include protective sleeves carried by the cable in vicinity of the fingers. Further in accordance with a feature of the invention, the cable is secured to the discs in brackets having a resilient mounting, in order to utilize the elasticity thereof only partially, which has an advantageous effect upon the durability thereof.

By an appropriate disposition of the fingers with respect to the sprinkler roller, the direction of the jet of dampening medium can be selected at will. In this connection, the dampening medium is sprinkled from the sprinkler roller substantially radially in a wedge-shaped widening space. This further advantage of the dampening unit permits the incorporation or installation thereof in any desired position within the offset printing machine.

other features which are considered as charateristic for the invention are set forth in the appended claims.

Although the invention is illustrated and described herein as embodied in dampening unit for offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in conjuction with the accompanying drawings, in which.

Figure 1:
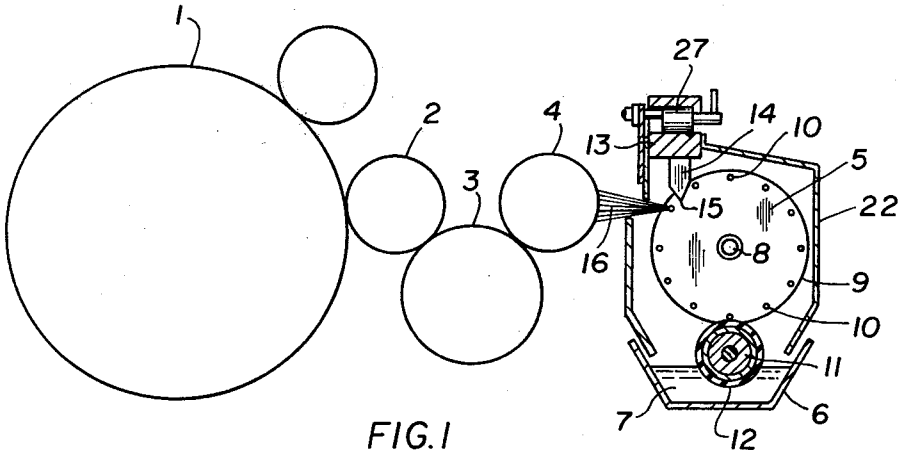
FIG. 1 is a partly diagrammatic and partly side elevational view of the dampening unit constructed in accordance with the invention.
Figure 2:
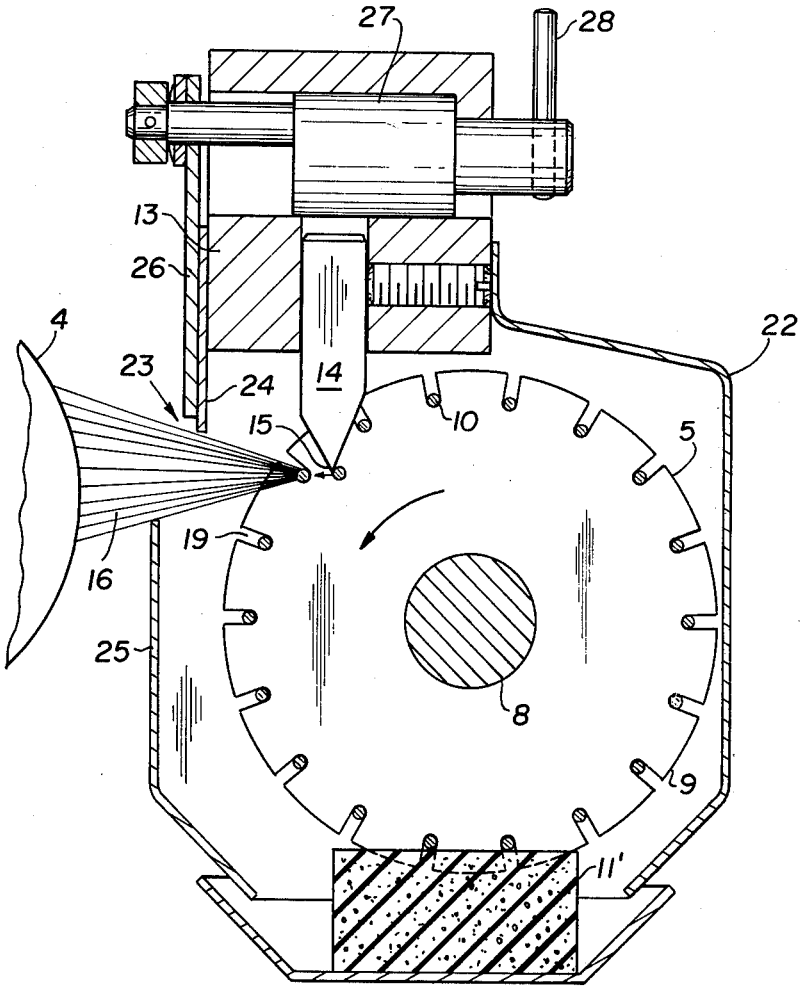
FIG. 2 is a fragmentary enlarged cross-sectional view of showing a modification of the dampening unit.

Referring now to the drawing and first, particularly, to FIGS. 1 and 2 thereof, there is shown a plate cylinder 1 of an offset printing machine supplied by dampening unit rollers 2, 3 and 4 in a conventional manner with dampening medium which is transferred contactlessly from a sprinkler roller 5 to the dampening-unit roller 4. A dampening-medium container or tank 6 for receiving dampening medium 7 is associated with the sprinkler roller 5.

Figure 3:
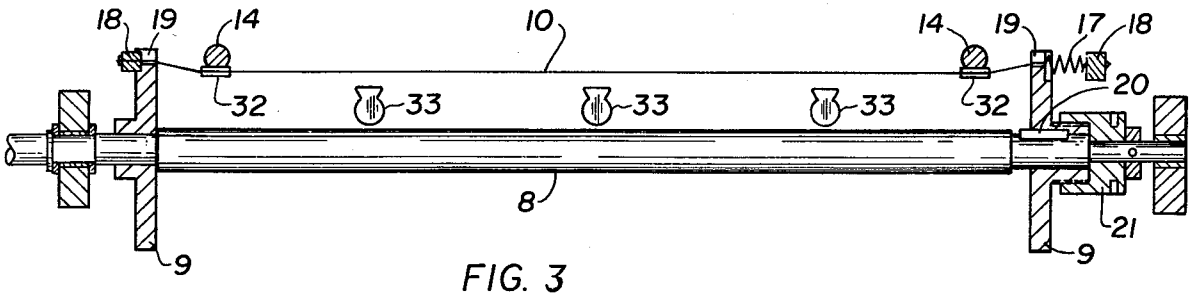
FIG. 3 is a longitudinal sectional view of the sprinkler roller forming part of the dampening unit.

The sprinkler roller 5 is formed of a rotary shaft 8 with discs 9 mounted at both ends thereof (FIG. 3). Thrower elements 10 extending parallel to the shaft 8 and forming an envelope of the sprinkler roller 5 are subjected to tension or clamped between the discs 9. The thrower elements 10 are wetted by a roller 11 having a water-bearing surface 12 which is immersed in the dampening medium 7 and is operatively engageable with the thrower elements 10 during rotation of the sprinkler roller 5.

Fingers 14 which are provided with an edge 15 at an end thereof facing toward thrower elements 10 are fastened to a traverse or cross-tie member 13. The fingers 14 are fastened to the traverse 13 at both ends of the sprinkler roller 15 slightly spaced from the discs 9, the fastening means being mountable so as to be adjustable or so that the fingers 14 are retractable or disengageable through suitable control means.

During rotation of the sprinkler roller 5 in direction of the curved arrow, as shown in FIG. 2, the thrower elements 10 come into engagement successively with the fingers 14 and move along the latter towards the edge 15 thereof. The tensioned thrower elements 10 are thereby deflected out of their extended straight position and subjected to additional tension. The instant the thrower elements 10 have reached the edge 15 of the fingers 14 they leap across the edge 15 and oscillate at high frequency in a plane extending through the fastening points thereof. They thereby throw off the dampening medium in very small droplets. The jet of dampening medium 16 strikes the dampening-unit roller 4 in fan-shaped fashion along the entire length thereof. The direction of the jet dampening medium 16 is variable at will and accommodated to the requirements of the printing machine by appropriate disposition and adjustment of the fingers 14. In order to produce the tension in the thrower elements 10, the latter may be braced against the discs 9 located at one end of the sprinkler roller 5 through compression springs 17. In this connection, the ends of the thrower elements 10 are feastened in terminal pieces 18. Notches 19 are formed in the discs 9 serve for relatively easily suspending the thrower elements 10.

One of the discs 9 is slideably mounted on the shaft 8 by a key 20 and is adjustable by means of a nut 21 (FIG. 3).

Instead of the roller 11 immersed in the container or tank 6 for dampening liquid 7, such as water, for example, stationary absorbent elements such as the element 11' as shown in FIG. 2, may be disposed in a manner that the surface thereof is engaged by the thrower elements 10 to which dampening medium is transferred due to the absorption action of the stationary absorbent elements. Air nozzles 33, as shown diagrammatically in FIG. 3, may also be associated zonewise with the thrower elements 10 and, due to the actuation thereof, the dampening medium can be blown off the thrower elements 10 by zones.

Figure 4:
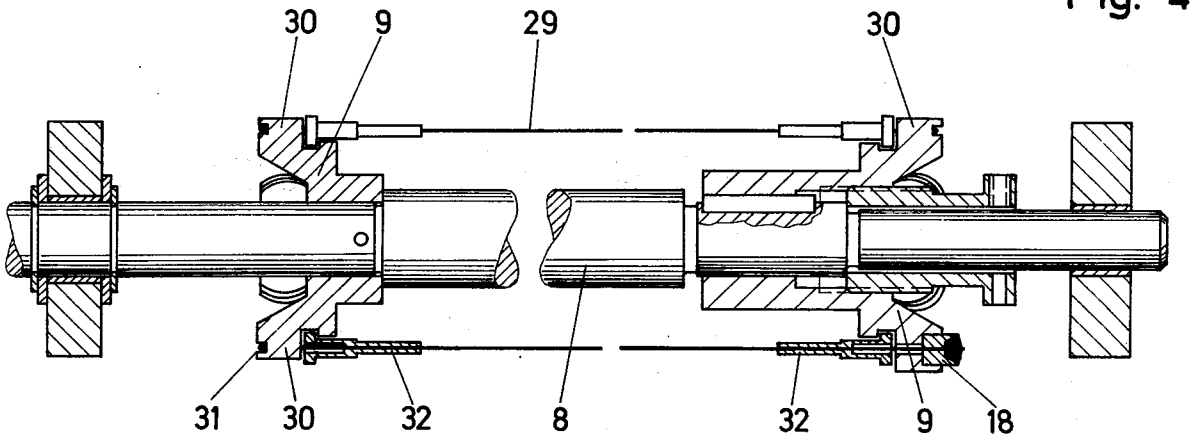
FIG. 4 is an enlarged longitudinal sectional view of another embodiment of the sprinkler roller of FIG. 3 having different means for securing the thrower elements thereof.
Figure 6:
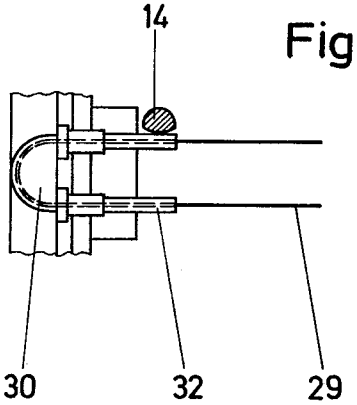
FIG. 6 is a fragmentary view of FIG. 5 as seen from the right-hand side thereof and showing the means of securing a thrower element to a disc of the dampening unit.
Figure 5:
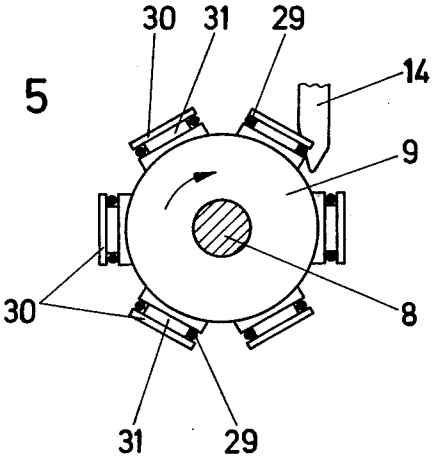
FIG. 5 is a view of the sprinkler roller as seen from the left-hand side of FIG. 4.

The sprinkler roller 5 is surrounded by a protective case or box 22 formed with a longitudinal slit 23 for passage therethrough of the jet of dampening medium 16. Shutters 24 and 25 serve to limit the jet of dampening medium 16. Adjustable shutters 26 for regulating the quantity of dampening medium zones are attached to the cross-tie member or traverse 13. By rotating eccentric pins 27 by means of respective handles 28, the shutters 26 can be adjusted to a greater or lesser extent into the region of the jet or spray of dampening medium 16, whereby the quanity of dampening medium to be transferred is varied and adjusted on the dampening-unit roller 4. The handles 28 thereby indicate, by the dispositionthereof, the respective adjustment of the shutters 26. The shutters 26 are secured to the traverse or ceosstie member 13 in close succession across the entire width of the sprinkler roller 5. The thrower elements 10 are constructed as cables formed of wire or synthetic material having a water-bearing surface. In an advantageous further feature of the invention, instead of individual thrower elements 10 extending between the discs 9, a continuous cable 29 is passed in loop-shaped conformation around the discs 9, the ends of the cable 29 being fastened in one disc 9 by terminal members 18 thereof. For this embodiment, as shown in FIGS. 4, 5 and 6, the discs 9 carry reversing cam members 30 with notches or grooves 31 to accommodate the cable 29.

In order to influence or control the jet of dampening medium or to cut off or discontinue the throwing action, the fingers 14 in the traverse or cross-tie member 13 may be made adjustable or displaceable out of the rotary path of the thrower elements 10, 29 by suitable conventional control means.

To prevent damage to the cables 29, the latter may carry protective sleeves 32 in the vicinity of the fingers 14. The cables 29 may also be fastened to the discs 9 in brackets having a resilient mounting, thereby limiting the tensile strength imposed upon the cables 29.

There are claimed:

1. Dampening unit for an offset printing machine comprising at least one dampening unit roller, a container for dampening medium and a rotatable sprinkler roller disposed mutually adjacent one another, said sprinkler roller comprising a shaft, a pair of discs disposed at opposite ends of said shaft and an envelope wettable by dampening medium from said container and formed of a plurality of means displaceable in a rotary path for throwing onto said dampening-unit roller from a region of an edge of said envelope extending along the length of said sprinkler roller droplets of dampening medium withdrawn from said container, said plurality of throwing means being stressed in tension between said discs and extending parallel to said shaft, and traverse means carrying a plurality of fingers disposed adjacent to and spaced from said discs and having respective edges projecting into said rotary path of said plurality of throwing means.

2. Dampening unit according to claim 1 including compression spring means located at one end of said sprinkler roller for bracing said plurality of throwing means against said discs.

3. Dampening unit according to claim 1 wherein one of said discs is slideably mounted on said shaft.

4. Dampening unit according to claim 1 wherein one of said discs is resiliently and adjustably mounted on said shaft.

5. Dampening unit according to claim 1 including a roller having a water-bearing surface rotatably moounted in said dampening-medium container, said water-bearing surface being operatively engageable with said plurality of throwing means.

6. Dampening unit according to claim 1 including stationary absorbent elements disposed in said dampening-medium container for transferring dampening medium therefrom to said plurality of throwing means.

7. Dampening unit according to claim 1, wherein the dampening medium droplets are thrown in a jet by said plurality of throwing means onto said opening unit roller, and including a protective case surrounding said sprinkler roller, said protective case being formed with a longitudinal slit and having shutter means for limiting the jet of dampening-medium droplets.

8. Dampening unit according to claim 1 including adjustable shutter means on said traverse means for regulating, by zones, the amount of dampening medium thrown by said plurality of throwing means onto said dampening-unit roller.

9. Dampening unit according to claim 1 including air nozzle means for blowing onto said dampening-unit roller, by zones, the dampening medium on said plurality of throwing means.

10. Dampening unit according to claim 1 wherein said plurality of throwing means are cables formed of material selected from the groups consisting of wire and synthetics and having a water-bearing surface.

11. Dampening unit according to claim 1 wherein said plurality of throwing means constitute respective lengths of a continuous cable extending in loop-shaped conformation around said discs, and including terminal members fastening the ends of said continuous cable in one of said discs.

12. Dampening unit according to claim 1 wherein said plurality of throwing means are in cable form, and including protective sleeves carried by said cable in vicinity of said fingers.

13. Dampening unit according to claim 1 wherein said fingers are adjustably fastened to said traverse means.

14. Dampening unit according to claim 1 including control means for displacing said fingers out of said rotary path of said plurality of throwing means.

15. Dampening unit according to claim 1 wherein said plurality of throwing means are in cable form, and are secured to said discs in brackets having a resilient mounting.

* * * * *